US007845984B2

(12) United States Patent
Schaffer et al.

(10) Patent No.: US 7,845,984 B2
(45) Date of Patent: Dec. 7, 2010

(54) POWER-ENABLED CONNECTOR ASSEMBLY AND METHOD OF MANUFACTURING

(75) Inventors: Christopher P. Schaffer, Fallbrook, CA (US); Thomas Rascon, Temecula, CA (US)

(73) Assignee: Pulse Engineering, Inc., San Diego, CA (US)

( * ) Notice: Subject to any disclaimer, the term of this patent is extended or adjusted under 35 U.S.C. 154(b) by 0 days.

(21) Appl. No.: 12/495,653

(22) Filed: Jun. 30, 2009

(65) Prior Publication Data

US 2010/0009576 A1 Jan. 14, 2010

Related U.S. Application Data

(60) Provisional application No. 61/133,782, filed on Jul. 1, 2008.

(51) Int. Cl.
*H01R 13/66* (2006.01)

(52) U.S. Cl. ..... 439/620.18; 439/676

(58) Field of Classification Search ..... None
See application file for complete search history.

(56) References Cited

U.S. PATENT DOCUMENTS

| | | | | |
|---|---|---|---|---|
| 5,015,981 | A | 5/1991 | Lint et al. | |
| 5,973,932 | A | 10/1999 | Nguyen | |
| 5,986,894 | A | 11/1999 | Lint et al. | |
| 5,991,885 | A | 11/1999 | Chang et al. | |
| 6,005,463 | A | 12/1999 | Lint et al. | |
| 6,344,969 | B1 * | 2/2002 | Lord et al. | 361/679.41 |
| 6,395,983 | B1 | 5/2002 | Gutierrez | |
| 6,585,540 | B2 | 7/2003 | Doyle, III et al. | |
| 6,593,840 | B2 | 7/2003 | Morrison et al. | |
| 6,633,998 | B1 | 10/2003 | Lau | |
| 6,642,827 | B1 | 11/2003 | McWilliams et al. | |
| 6,764,343 | B2 * | 7/2004 | Ferentz | 439/620.01 |
| 6,945,820 | B1 * | 9/2005 | Blichasz et al. | 439/620.05 |
| 6,962,511 | B2 | 11/2005 | Gutierrez | |
| 7,052,315 | B2 * | 5/2006 | Murr et al. | 439/540.1 |
| 7,155,622 | B2 | 12/2006 | Mancy et al. | |
| 7,187,268 | B1 | 3/2007 | Armstrong et al. | |
| 7,230,412 | B2 | 6/2007 | Stineman et al. | |
| 7,241,181 | B2 | 7/2007 | Machado et al. | |
| 2006/0092000 | A1 * | 5/2006 | Karam et al. | 340/310.11 |
| 2007/0015416 | A1 | 1/2007 | Gutierrez | |
| 2007/0206774 | A1 | 9/2007 | Vorenkamp et al. | |
| 2008/0248684 | A1 * | 10/2008 | Filipon et al. | 439/485 |

* cited by examiner

*Primary Examiner*—Michael C Zarroli
(74) *Attorney, Agent, or Firm*—Gazdzinski & Associates, PC

(57) ABSTRACT

A connector assembly enabled to receive and distribute power signals. In one embodiment, the connector comprises a multi-port modular jack, and incorporates a PSE controller board disposed in the rear portion of the connector assembly, e.g., outside the connector housing. The PSE controller board controls the power to a powered device and may be adapted to, for example, distinguish whether the device is a short circuit or a network interface card, guarantee the supply of power to selected ports, and prevent cables from transmitting abnormal power. Heat removal features are also optionally utilized to dissipate heat produced by the electronic or signal conditioning components utilized on said multi-port modular jack. In some embodiments, the PSE controller board is also optionally made removable from the jack housing.

15 Claims, 7 Drawing Sheets

POWER-ENABLED CONNECTOR ASSEMBLY AND METHOD OF MANUFACTURING

PRIORITY AND RELATED APPLICATIONS

This application claims priority to U.S. Provisional Patent Application Ser. No. 61/133,782 filed Jul. 1, 2008 of the same title, which is incorporated herein by reference in its entirety. In addition, this application is related to U.S. patent application Ser. No. 11/387,226 filed Mar. 22, 2006 (published as U.S. Patent Publication No. 2007/0015416) to Gutierrez; et al and entitled "Power-enabled connector assembly and method of manufacturing", which is also incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

1. FIELD OF THE INVENTION

The present invention relates generally to the field of data communication, electrical power distribution and/or delivery systems. Specifically, the invention is directed in one exemplary aspect to improved apparatus and methods for supplying electrical power and data in a local area network to devices adapted to receive electrical power and data.

2. DESCRIPTION OF RELATED TECHNOLOGY

The IEEE 802.3af standard (IEEE Std. 802.3af —"IEEE Standard for Information technology—Telecommunications and information exchange between systems—Local and metropolitan area networks—Specific requirements" dated 2003, and incorporated herein by reference in its entirety) as well as upcoming IEEE Std. 802.3 at both of which defining systems for supplying power over Ethernet cabling. More specifically, IEEE 802.3af defines a so-called Power over Ethernet (PoE) system that involves delivering power over unshielded twisted-pair wiring from Power Sourcing Equipment (PSE) to a Powered Device (PD) located at opposite sides of a link, while IEEE 802.3 at looks to increase the amount of power transmitted over ethernet cabling over the IEEE802.3af standard. Traditionally, network devices have required two connections: one to a LAN and another to a power supply. The PoE system eliminates that need for two connections and, instead, power is supplied over the same Ethernet cabling used for data transmission.

A PSE is the equipment electrically specified at the point of the physical connection to the cabling that provides the power to a link. A PSE may be either end-span or mid-span. An end-span PSE is a PoE enabled switch wherein the power is supplied directly from the data ports. An end-span PSE is typically associated with an Ethernet switch, router, hub or other network switching equipment or the like. Alternatively, a mid-span PSE supplies power via spare wires. A PD is a device that is either drawing power or requesting power.

A PSE's main functions are to search the link for a PD requesting power, optionally classify the PD, supply power to the link if a PD is detected, monitor the power on the link, and disconnect power when it is no longer requested or required. A PD participates in the PD detection procedure by presenting a PoE detection signature defined by the IEEE 802.3af standard. The PD detection signature has electrical characteristics measured by the PSE, such as a signature resistance in a range from 19 to 26.5 K.OMEGA.

PoE technology has enabled the transmission of electrical power along with data to pass via standard twisted pair cable in an Ethernet network to devices. Existing modular jack/connector technology commonly utilizes the IEEE 802.3af standard to provide power over data lines.

FIG. 1 illustrates a typical prior art PoE enabled connector apparatus 100. The system includes power sourcing equipment (PSE) having multiple PoE ports (Port 1-Port n) connectible to powered devices (PD1-PDn) via twisted pair Ethernet cable links. One or more PSE chips may be disposed within the connector apparatus and interact with each PD, per the IEEE 802.3af standard. However, prior art PoE enabled connectors 100 were not intended to be modular (i.e. the PSE chips and associated circuitry were not intended to be easily removable), and were enclosed within the connector housing and/or shielding apparatus, thereby resulting in significant heat accumulation within the connector.

U.S. Pat. No. 5,991,885 to Chang, et al. issued Nov. 23, 1999 and entitled "Method and apparatus for detecting the presence of a remote device and providing power thereto" discloses a network that detects the presence of a remote terminal connected to a network and determines the functional protocol of the remote terminal. If the remote terminal is an infrared adapter, the network hub provides electrical power to the infrared adapter and continually monitors for the presence of the infrared adapter. Upon removal of the infrared adapter, the network removes electrical power that is applied to a user interface connector that connects to the infrared adapter. If another protocol is detected for the remote terminal, the network hub communicates with the remote terminal in that protocol and converts the data to the protocol of the network.

U.S. Pat. No. 6,633,998 to Lau issued Oct. 14, 2003 and entitled "Multiple communications port unit and computer architecture" discloses a multiple communications port unit for coupling plural peripheral devices to a computer. The multiple communications port unit includes a network port for being coupled to a supervisory computer, communications ports for being coupled to the peripheral devices, and a power supply unit suitable for using the substation battery at an electric distribution substation for input power. The power supply unit includes redundant power supplies, an input conditioning circuit and a sensing and annunciation circuit for providing a warning of a power supply malfunction.

Considering the foregoing prior art solutions, improved connector apparatus and methods are needed to provide, inter alia, PoE functionality in a more space-efficient manner. Further, as connector/jack technology becomes increasingly miniaturized, higher component densities are employed, thereby increasing the rate of heat generation from such active components. Thus, such improved connector apparatus would also ideally provide the ability to remove or dissipate such heat before damage can occur. Specifically, none of the foregoing prior art solutions appear to contemplate power sourcing equipment ("PSE") which is specifically adapted to manage the heat generated by such active components within the small physical constraints of a jack or connector while still providing high yields, affordability to a consumer and effective utilization of the existing standard footprint.

Accordingly, an improved PoE enabled connector apparatus with PSE components capable of managing heat generation while maintaining a high yield and low cost is needed.

Ideally, such an apparatus would: (i) integrate power delivery (e.g., PoE) functionality into a modular connector design; (ii) provide a mechanism for the effective dissipation of heat generated by these PoE circuits; (iii) maintain yields on par or better than current systems; and (iv) provide cost-effective options for delivering power while maintaining heat dissipation.

SUMMARY OF THE INVENTION

The present invention satisfies the foregoing needs by providing inter alia an improved apparatus and methods for power delivery and receipt via, e.g., circuitry associated with a modular jack or other connector type.

In a first aspect of the invention, a multi-port connector assembly is disclosed. In one embodiment, the ports of the disclosed multi-port assembly are capable of supplying power in addition to data. The connector assembly further comprises a processor which controls the supply of power to the ports. The disclosed processor and associated circuitry is, in some embodiments, disposed on a face of the connector assembly.

In one variant, the face comprises an external face of the connector assembly. In an alternative variant, the external face comprises a top face of the connector assembly.

In another variant, the connector assembly further comprises a heat sink disposed at least partly on the processor.

In another variant, the connector assembly is at least partly encased by one or more faraday shields.

In another variant, light indicators are incorporated into the connector assembly.

In yet another variant, the substrate is disposed removably onto the connector assembly without necessitating a de-soldering operation.

In yet another variant, the substrate is capable of being disposed onto the connector assembly after the connector assembly has otherwise been fully assembled.

In yet another variant, the substrate further comprises a shielding layer. In an alternative variant, the shielding layer is electrically coupled to an external shield disposed about the connector assembly.

In yet another variant, the connector assembly further comprises an external shielding apparatus.

In yet another variant, the substrate is disposed external to the external shielding apparatus.

In a second embodiment, the apparatus for providing power over data cabling comprises a connector assembly comprised of a plurality of ports and further comprising an external substrate mounting interface and an external shield. The apparatus further comprises a substrate comprising one or more heat-generating electronic components for providing power over data cabling associated with one or more of the plurality of ports with the substrate mounted to the connector assembly via the external substrate mounting interface.

In a variant, the one or more heat-generating electronic components disposed on the substrate is operable to: detect a compatible powered device (PD); determine a power classification signature for the compatible PD; and supply power to the compatible PD.

In yet another variant, the external substrate mounting interface comprises a solder-less mounting interface.

In yet another variant, the external substrate mounting interface is disposed on a deck surface associated with the connector assembly.

In yet another variant, the deck surface is parallel with a top surface of the connector assembly, the deck surface disposed substantially below the top surface of the connector assembly.

In yet another variant, an upper most component of the one-or-more heat generating electronic components is disposed entirely below the top surface of the connector assembly when the substrate is mounted on the external substrate mounting interface and the deck surface.

In a second aspect of the invention, a method for providing power over data lines is provided. In one embodiment, the method comprises providing a connector assembly which comprises a multiplicity of ports, and a processor disposed on a face of the connector assembly; controlling the supply of power by the power source, via the processor; providing a heat sink; and disposing the connector assembly in electrical communication with a circuit board.

In a third aspect of the invention, an electronic system incorporating the connector assembly is disclosed. In one embodiment, the system comprises a connector assembly including a processor which controls power to the ports of the connector assembly (e.g., PSE under IEEE-Std. 802.3af) that is mounted on and in electrical communication with a substrate such as a PCB, and also that is in electrical communication with a device to be powered (e.g., PD).

In a fourth aspect of the invention, business methods utilizing the aforementioned apparatus and methods are provided.

In a fifth aspect of the invention, a method for assembling the aforementioned apparatus are provided. In one embodiment, the method comprises assembling a connector assembly comprised of a plurality of ports, the ports being capable of supplying a power signal and a data signal; obtaining a controllable power source and a processor disposed on a substrate, the processor adapted to control the supply of power by the power source; and disposing the substrate comprising the controllable power source and the processor subsequent to the assembling of the connector assembly.

In one variant, the substrate is disposed removably onto the connector assembly such that it can be removed without necessitating a de-soldering operation.

In another variant, the act of disposing the substrate is performed using a solder free assembling operation.

In another variant, the substrate is disposed onto a top deck associated with the connector assembly.

In a sixth aspect of the invention, a single port connector assembly is disclosed. In one embodiment, the port of the disclosed single port assembly is capable of supplying power in addition to data. The connector assembly further comprises a processor which controls the supply of power to the port. The disclosed processor and associated circuitry is, in some embodiments, disposed on a face of the connector assembly.

BRIEF DESCRIPTION OF THE DRAWINGS

The features, objectives, and advantages of the invention will become more apparent from the detailed description set forth below when taken in conjunction with the drawings, wherein.

DETAILED DESCRIPTION OF THE PREFERRED EMBODIMENT

Figure 1:
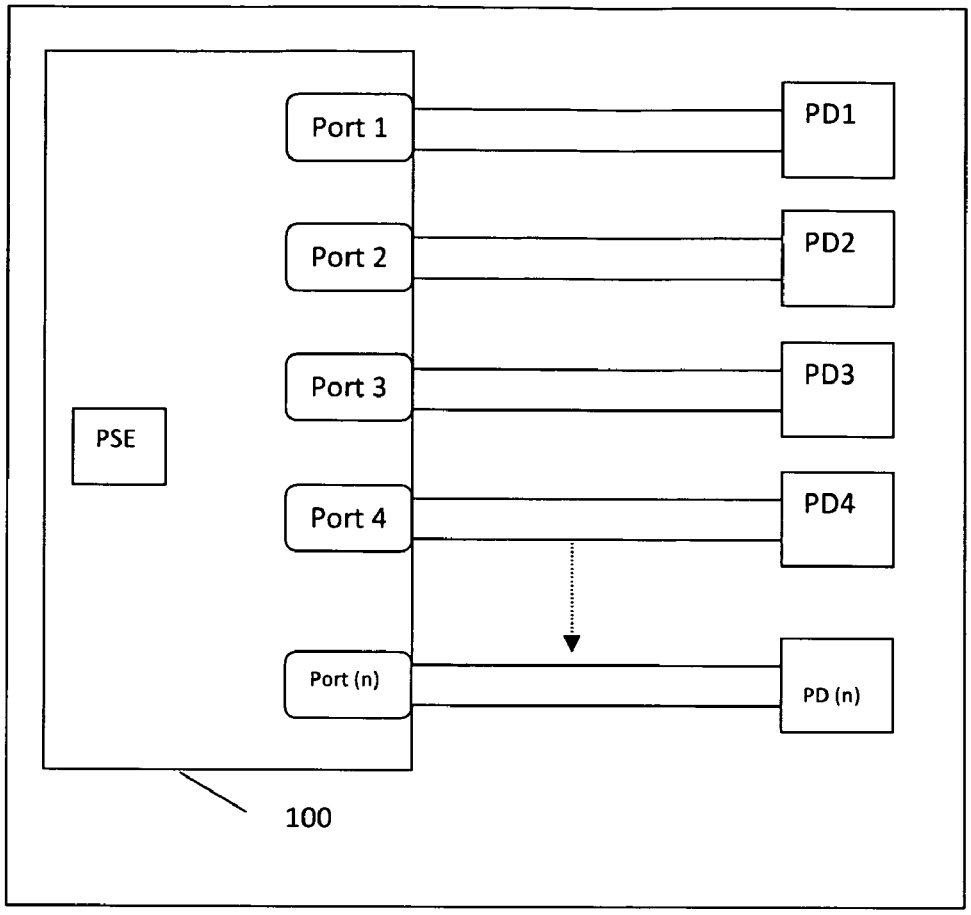
FIG. 1 (PRIOR ART)
FIG. 1 is a top plan view of a typical prior art PSE enabled connector assembly.

Reference is now made to the drawings wherein like numerals refer to like parts throughout.

It is noted that while the following description is cast primarily in terms of a RJ-type connector and associated modular plugs of the type well known in the art, the present invention may be used in conjunction with any number of different connector types. Accordingly, the following discussion of the RJ connectors and plugs is merely exemplary of the broader concepts.

As used herein, the terms "electrical component" and "electronic component" are used interchangeably and refer to components adapted to provide some electrical function, including without limitation inductive reactors ("choke coils"), transformers, filters, gapped core toroids, inductors, capacitors, resistors, operational amplifiers, and diodes, whether discrete components or integrated circuits, whether alone or in combination. For example, the improved toroidal device disclosed in U.S. Pat. No. 6,642,827 to McWilliams, et al. issued Nov. 4, 2003 entitled "Advanced Electronic Microminiature Coil and Method of Manufacturing" which is incorporated herein by reference in its entirety, may be used in conjunction with the invention disclosed herein.

As used herein, the term "signal conditioning" or "conditioning" shall be understood to include, but not be limited to, signal voltage transformation, filtering, current limiting sampling, processing, conversion, regulation, distribution, and time delay.

As used herein, the term "integrated circuit (IC)" refers to any type of device having any level of integration (including without limitation ULSI, VLSI, and LSI) and irrespective of process or base materials (including, without limitation Si, SiGe, CMOS and GAs). ICs may include, for example, memory devices (e.g., DRAM, SRAM, DDRAM, EEPROM/Flash, ROM), digital processors, SoC devices, FPGAs, ASICs, ADCs, DACs, transceivers, and other devices, as well as any combinations thereof.

As used herein, the term "digital processor" is meant generally to include all types of digital processing devices including, without limitation, digital signal processors (DSPs), reduced instruction set computers (RISC), general-purpose (CISC) processors, microprocessors, gate arrays (e.g., FPGAs), Reconfigurable Compute Fabrics (RCFs), and application-specific integrated circuits (ASICs). Such digital processors may be contained on a single unitary IC die, or distributed across multiple components.

As used herein, the term "port pair" refers to an upper and lower modular connector (port) which are in a substantially over-under arrangement; i.e., one port disposed substantially atop the other port, whether directly or offset in a given direction.

As used herein, the term "IEEE Std. 802.3af" and "IEEE Std. 802.3at" refers to any and all variants, drafts, request-for-comment (RFC) versions, revisions and supporting documentation or specifications/standards relating to PoE standards, including without limitation IEEE Standard 802.3af, entitled "IEEE Standard for Information technology, Telecommunications and information exchange between systems, Local and metropolitan area networks, Specific requirements, Part 3: Carrier Sense Multiple Access with Collision Detection (CSMA/CD) Access Method and Physical Layer Specifications Amendment: Data Terminal Equipment (DTE) Power via Media Dependent Interface (MDI)", each of the foregoing being incorporated herein by reference in its entirety.

As used herein, the term "Power Sourcing Equipment" or "PSE" refers generally to devices (such as, without limitation, those in accordance with IEEE Std. 802.3af or equivalent) which are adapted to deliver electrical power signals.

As used herein, the term "Powered Device" or "PD" refers generally to devices which are capable of being powered from another device, including without limitation over an Ethernet cable according to IEEE Std. 802.3af or equivalent. PD devices may include for example, without limitation, Wireless Access Points, IP Telephony devices, PDA recharging stands, portable test equipment and telecom power control devices.

As used herein, the term "interlock base" refers generally to a substantially insulating structure for use with electronic components, such as for example those disclosed in U.S. Pat. No. 5,015,981 to Lint, et al. issued May 14, 1991 entitled "Electronic microminiature packaging and method", U.S. Pat. No. 5,986,894 to Lint, et al. issued Nov. 16, 1999 entitled "Microelectronic component carrier and method of its manufacture", U.S. Pat. No. 6,005,463 to Lint, et al. issued Dec. 21, 1999 entitled "Through-hole interconnect device with isolated wire-leads and component barriers", U.S. Pat. No. 6,395,983 to Gutierrez issued May 28, 2002 entitled "Electronic packaging device and method", or U.S. Pat. No. 6,593,840 to Morrison, et al. issued Jul. 15, 2003 entitled "Electronic packaging device with insertable leads and method of manufacturing", each of the foregoing incorporated herein by reference in its entirety.

Multi-Port Embodiment

In the representations discussed below, it will be appreciated that while described primarily in the context of an RJ-type modular jack (e.g., RJ-45 jack), the invention is in no way limited to such configurations, and may be more broadly applied to other types of connector assembly.

Figure 2:
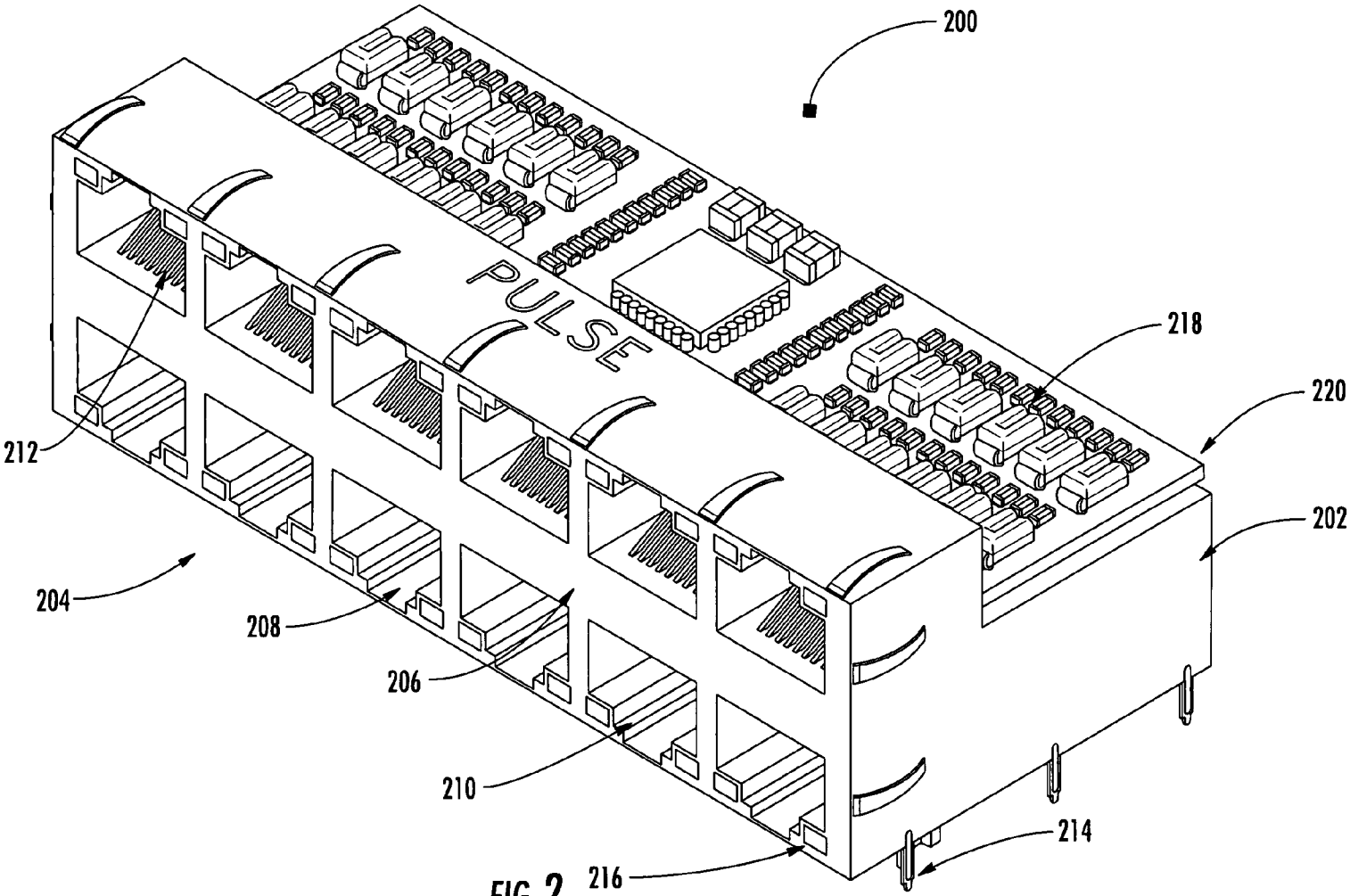
FIG. 2 is a front perspective view of a first embodiment of a PSE enabled connector assembly in accordance with the principles of the present invention.

As shown in FIG. 2, in one exemplary embodiment, a multi-port (i.e., 1×N, 2×N, etc.) assembly 200 is provided. The embodiment of FIG. 2 illustrates a 2×6 device; however, it will be appreciated that any number of multi-port arrangements may be utilized in accordance with the principles of the present invention. The invention in its multi-port configuration integrates PoE functionality into one or more ports of a multi-port connector, thereby providing a high-density PoE solution for a plurality of ports associated with a parent device.

The exemplary assembly 200 comprises a connector housing element (hidden from view) comprising multiple ports 204 formed therein. Each port 204 comprising a plug recess 208. Note that the plug recesses 208 are formed in the front wall 206 of the assembly 200 such that that a modular plug may be inserted into the connector without interference. Note however that the term "front" is relative to the disposition of the connector. For example, in the context of a vertical mounted connector (not shown), the term front wall would more appropriately be described as a "top wall".

The connector housing element in the illustrated embodiment is electrically non-conductive and is formed from a thermoplastic (e.g. PCT Thermex, IR compatible, UL94V-0), although it will be recognized that other materials including other thermosets, polymers, etc., may conceivably be used. It is further recognized, however that a conductive or semi-conductive material may be used in certain applications, such as where the aforementioned conductors are otherwise insulated from the housing. In the illustrated embodiment, an injection molding process is used to form the housing element, although other processes may be used such as machining operations, transfer molding or die-casting processes, depending on the material chosen. The selection and manufacture of the housing element is well understood in the art, and accordingly will not be described further herein. The housing may also comprise a one-piece or multi-piece construction.

As is well understood in the connector arts, the connector assembly 200 may also be shielded with, inter alia, an external tin or alloy noise or Faraday shield 202. This shield 202 may also be used for other purposes including, e.g., heat dissipation as described in greater detail subsequently herein.

Each plug recess 208 is adapted to receive a modular plug (not shown); thus, each plug recess 208 is lined with a plurality of grooves 210 which are disposed generally parallel and oriented vertically within the connector housing. The grooves 210 are conformed to fit to the physical shape of the modular plug the plug recess 208 is adapted to receive. The modular plug includes a plurality of electrical conductors (modular plug conductors) disposed thereon in a predetermined array. Thus, each plug recess 208 is also adapted to include conductors 212 (connector conductors) which correspond to those of the modular plug, thereby forming an electrical connection between the modular plug conductors and connector conductors 212 when the modular plug is inserted into the plug recess 208.

The connector conductors 212 are formed in a predetermined shape and held within the connector housing. The ends of the connector conductors 212 are formed such that they rest within the plug recess in a manner that causes the ends of the connector conductors 212 to mate with the conductors of the modular plug when the latter is inserted into the plug recess 208.

In one embodiment, the connector conductors are formed in a header assembly (not shown) which is comprised of a row of juxtaposed connector conductors 212 and an insulative header element. In accordance with this embodiment, the header element is inserted into the connector housing. The header assembly of this embodiment may be prepared by insert-molding the conductors 212 into the header element, which may be comprised for example of an injection-molded polymer.

It will also be recognized that, in the context of multi-port embodiments, separators or EMI shields may be disposed between the conductor sets of any given header assembly (or between adjacent ones of the juxtaposed assemblies) so as to minimize electrical noise and cross-talk between multiple header assemblies and their respective conductor sets 212 and/or between other components. For example, the multi-dimensional shielding apparatus and techniques described in U.S. Pat. No. 6,585,540 to Gutierrez, et al. issued Jul. 1, 2003 entitled "Shielded microelectronic connector assembly and method of manufacturing" and incorporated herein by reference in its entirety may be readily adapted for use consistent with the present invention. Other shielding configurations may also be used, the foregoing being but one option. Furthermore, other techniques well known in the electronic arts for minimizing EMI and/or cross-talk may be used consistent with the invention if desired.

Advantageously, the exemplary connector assembly 200 can be configured if desired as either a GBE, a 10/100 device, or otherwise, simply by inserting a different configuration insert assembly comprising the respective electronic circuitry for each of these configurations into the connector housing such as, for example, is described in U.S. Pat. No. 7,241,181 to Machado et al. issued Jul. 10, 2007 and entitled "Universal connector assembly and method of manufacturing" and incorporated herein by reference in its entirety. This simplifies manufacturing, since the connector housing, noise shields, etc. can be identical for each different variant; the only changes necessary relate to the electronic components (discussed below).

The illustrated connector assembly 200 also includes electronic components disposed within the connector housing. The electronic components which may be any manner of discrete components such as resistors, capacitors, etc. or integrated circuits are disposed on one or more substrates, each of which may be single or multi-layered substrates. The substrates are assembled and positioned within the connector housing such that when the connector assembly 200 is fully assembled and a modular device is inserted into one port 204, an electrical pathway is formed between the conductors of the electrical device (modular plug conductors), the assembly conductors 212, and a plurality of external terminals (not shown) which link the assembly 200 to the device on which it is disposed, e.g. a circuit board. In one embodiment, eight (8) standard size power pins per assembly are utilized to link the assembly 200 to a motherboard. This allows for, inter alia, standard sized pins instead of expensive, higher power rated pins. Electrical communication described above may occur via wire-wrapping, soldering, welding, or the like.

In a power over Ethernet (PoE) system, the power sourcing equipment (PSE) provides power and data to a powered device (PD) via conductor pairs capable of carrying high speed differential data communications. The PSE is comprised of a transceiver physical layer (PHY) which has full-duplex send and receive capabilities via a respective transmit and receive port. Each port 204 further comprises one or more transformers which couple high speed data between the conductor pairs and transceiver ports. The DC supply outputs a voltage (e.g. 48 Volts) which the transformers receive and isolate. The voltage/power may be varied depending on the particular requirements of the PD. The PSE also includes a PSE controller which controls the DC power supply based on the needs of the PD.

As illustrated in FIG. 2, the PSE controller circuitry 218 is disposed on the controller board (or substrate) 220. The PSE controller measures the voltage, current, and temperature of the outgoing and incoming DC supply lines so as to characterize the power requirements of the PD. The PSE controller also, inter alia, detects and validates a compatible PD, determines a power classification signature for the validated PD, supplies power to the PD, monitors the power, and reduces or removes the power from the PD when the power is no longer requested or required. During detection, if the PSE controller determines the PD to be non-compatible, the PSE controller can be adapted to prevent the application of power to that PD device, protecting the PD from possible damage. For example, the apparatus and methods disclosed in United States Patent Application No. 20070206774 to Vorenkamp, et al. published Sep. 6, 2007 and entitled "Apparatus and method for classifying a powered device (PD) in a power source equipment (PSE) controller" and incorporated herein by reference in its entirety, may be used consistent with the present invention.

The PSE controller board circuitry 218 is generally comprised of electronic components (with functionality specified above) and is disposed on the PSE controller board 220. The controller board 220 is mounted on an outside face of the connector assembly 200 (i.e. outside of the connector housing). In the embodiment shown, the controller board circuitry 218 is disposed "on top" of the connector assembly 200. However, the orientation of the substrate 220 containing the controller board circuitry 218 is not so limited. For instance, in the context of a vertical mounted connector (not shown), the controller board circuitry 218 could be mounted on a "side wall" or "side face." In yet another embodiment, the controller board circuitry 218 on the substrate 220 could be mounted on a "back face" of the connector assembly 200. However it is noted that in most embodiments it is preferable to have the controller board circuitry 218 mounted behind the ports 204.

As illustrated in FIG. 2, in one embodiment, the shape of the connector assembly 200 is such that the height of the assembly face on which the ports 204 are disposed is greater than that of the face opposite the face on which the ports 204 are disposed. Thus, when the connector is assembled, a "deck" is formed behind the uppermost row of ports 204. The controller board 218 of FIG. 2 is advantageously disposed on the deck, and thus, on top of the connector assembly 200 and behind the ports 204. The difference in height of the two faces may be specifically prescribed depending on the height required for apparatus mounted on the deck. It may also be appreciated that the "deck" may be formed on any face of the connector assembly 200 as may be advantageous for the particular disposition of the connector assembly 200 on the motherboard, or other device.

The PSE controller board substrate 220 is preferably mounted via a "snap on" or similar selectively removable mechanism rather than more permanent displacement as by soldering. However, soldering or other similar methods of fixing the controller board substrate 220 to the connector apparatus may be used in practicing the invention.

Providing a 2×N PoE enabled connector (as exemplified in FIG. 2) with a "snap on" or other PSE module mounted on top of the connector offers significant advantages over other configurations. First, this configuration permits the manufacturer to outsource the manufacture of PSE controller boards. In this approach, a connector assembly manufacturer may manufacture connector assemblies on which PSE controller boards may be mounted; then, the manufacturer may purchase PSE controller boards from a manufacturer of such. The connector assembly manufacturer may mount the PSE controller board on the pre-manufactured connector assembly. In this way, the connector assembly manufacturer is not burdened with adding the overhead of the PSE chip and components in costing the solution. The "snap on" or other such configuration further permits the purchaser to implement any of the PSE chips available on the market. Also, the "snap on" configuration provides for higher yields because, by breaking up the filtered connector from the PSE board, rework costs are minimized as the board can be removed and placed on another connector. This means that, inter alia, one type of connector assembly and/or PSE controller board may be substituted for another. Thus, if either component ceases functioning properly, they can be individually and independently exchanged thereby saving costs to the purchaser.

The "snap on" configuration also has the added benefit of more effectively utilizing precious board space. This configuration optimizes "dead space" in the standard 2×N connector module by providing an integrated PoE solution in the standard footprint.

Finally, there is a significant thermal advantage in keeping the active PSE chip outside of the connector shield; i.e., better conduction, convection, and/or radiation of heat from the device. It is however recognized that other embodiments may be implemented consistent with the principles of the present invention. For example, additional shielding may be implemented within the substrate 220 itself, (i.e. via a conductive copper layer), which advantageously is coupled to the external shield 202 as well. Alternatively, shielding could be incorporated into the heat sink (not shown), or alternatively disposed between the substrate 220 and the connector shield 202.

Figure 3:
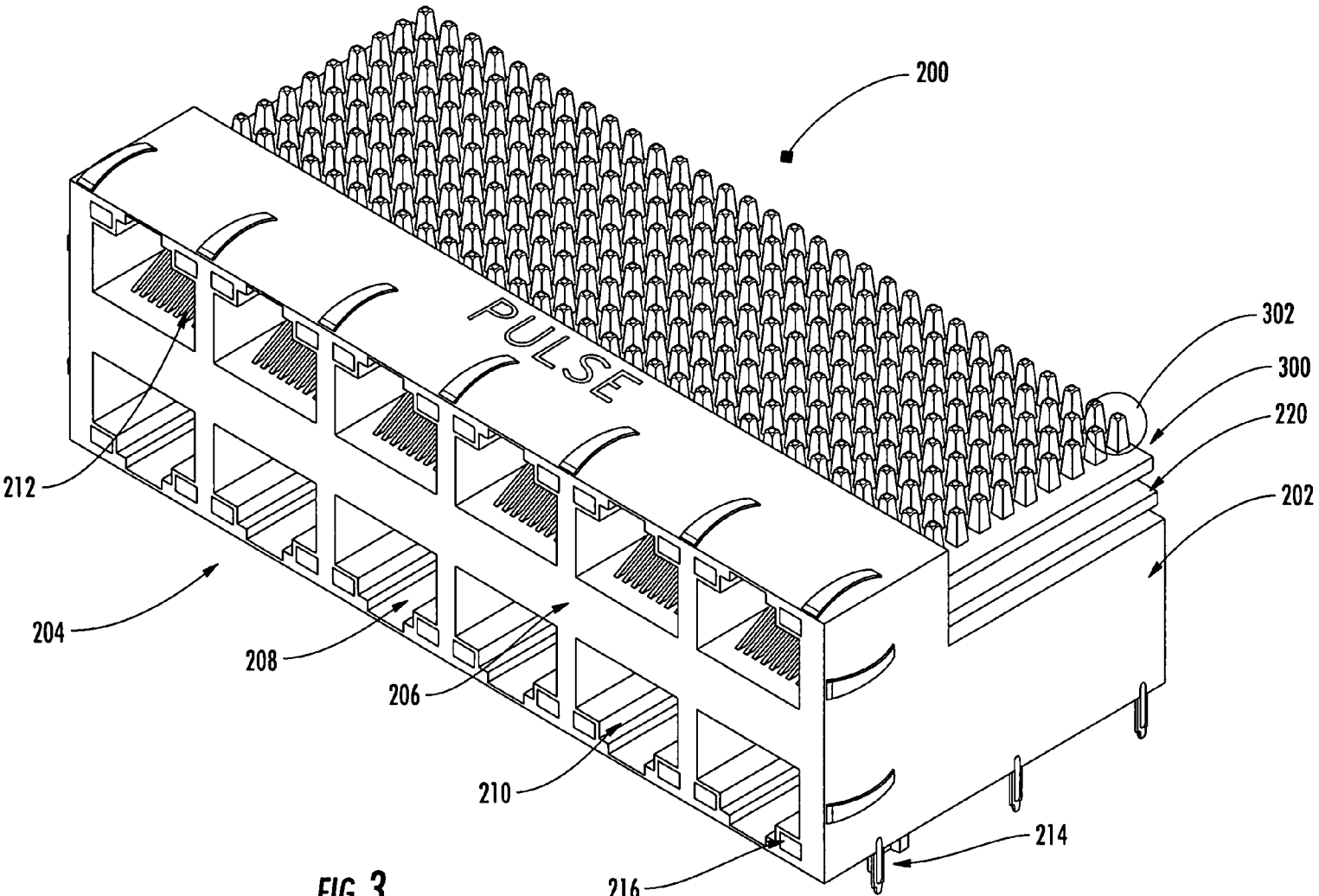
FIG. 3 is a front perspective view of a second embodiment of a PSE enabled connector assembly having a heat sink, in accordance with the principles of the present invention.

In another embodiment, illustrated in FIG. 3, thermal considerations are further addressed by mounting a heat sink 300 on top of the PSE controller substrate 220. The location of the heat sink 300 on top of the PSE controller substrate provides improved cooling regardless of a vertical or horizontal mounting of the motherboard. The heat sink 300 is disposed on the PSE controller board circuitry 218 in a manner that facilitates simple placement thereon, and subsequent removal; this can be accomplished via several non-permanent and non-permanent affixing techniques, including, inter alia, the "snap on" configuration discussed above with regard to the attachment of the PSE controller board 218 to the connector assembly 200.

The heat sink 300 can be used to absorb heat from the power control circuitry and dissipate this heat outside of the device (or into portions of the device itself which subsequently dissipate the heat outside of the device). The heat sink 300 is desirably made from a good heat dissipating material such as copper or aluminum, and may even optionally be plated with another material, such as gold, on its outer surfaces to increase the thermal transfer of the device. Other materials may be used as well. In the illustrated embodiment, the heat sink 300 advantageously utilizes "fins" 302 of the type well known in the art, which increase surface area of the heat sink allowing faster dissipation of heat into the ambient environment. Other such structures or features may also be used, such as a thermally conductive paste which ensures that thermally insulating air gaps or voids are filled, thereby enhancing heat flow.

While the embodiment illustrated in FIG. 3 shows the heat sink residing only on top of the substrate 220, it is appreciated that other configurations for the heat sink could be utilized to increase heat dissipation. For example, the heat sink could be extended so as to wrap around the back of the connector assembly 200, thereby improving heat dissipation by increasing the surface area of the heat sink 300.

As is illustrated in FIGS. 2 and 3, the exemplary embodiment of the connector assembly 200 also optionally includes one or more light indicators 216. The light source of each light indicator 216 is fitted into recesses formed on the connector housing. It is appreciated that frictional fit, snap fits, heat staking, adhesives, etc. may be used to dispose the light indicators 216 in the connector housing recesses as is well understood in the electronic arts. Note also that the recesses within the housing element may be coated internally with a reflective coating of the type well known in the art to enhance the reflection of light energy radiated by the light source. The housing element also contains recesses for the light source conductors (not shown).

FIGS. 2 and 3 illustrate the light indicators 216 at the bottom of the connector assembly 200 for the ports 204 which are in the tab down configuration on the bottom row. The light indicators 216 are illustrated at the top of the assembly for those ports 204 which are in a tab up configuration. It will be appreciated that the light indicators 216 may be placed elsewhere in relation to the ports 204 as desired. A light pipe assembly as is well understood in the art (not shown) could also be used in either configuration if desired. This light pipe may comprise, for example, one or more source LEDs disposed on or proximate to the motherboard or other device to which the connector is mated, or alternatively a light source within the connector itself (whether near the motherboard or otherwise). See, e.g., the light pipe arrangement of co-pending and co-owned U.S. patent application Ser. No. 10/246,840 entitled "Advanced Microelectronic Connector Assembly and Method of Manufacturing" filed Sep. 18, 2002, issued as U.S. Pat. No. 6,962,511 on Nov. 8, 2005, incorporated herein by reference in its entirety, which details one exemplary light pipe arrangement useful with the invention.

The light sources for the light indicators 216 used in the connector assembly 200 may be LED lights which radiate visible light of the desired wavelength(s), such as green light from one LED and red light from the other. Multi-chromatic devices (such as a "white light" LED), or other types of light sources such as incandescent lights or even liquid crystal (LCD) or thin film transistor (TFT) devices are possible, all being well known in the electronic arts. Further, any number of configurations of light indicators may be used consistent with the present invention.

Where the light indicators 216 are composed of an LED light source, the connector assembly 200 may be configured to include noise shielding for the individual LEDs. LED shielding is accomplished by forming a thin metallic (e.g., copper, nickel, or copper-zinc alloy, etc.) layer on the interior walls of the LED recesses of the connector housing (or even over the non-conductive portions of LED itself prior to insertion of each LED. In a second embodiment, a discrete shield element (not shown) which is separable from the connector housing can be used, each shield element being formed so as to accommodate its respective LED and also fit within its respective recess in the connector housing. In yet another embodiment, an external noise shield may be fabricated and deformed within the recesses of the connector housing so as to accommodate the LEDs on the outer surface of the shield, thereby providing noise separation between the LEDs and the individual connector conductors 212. A myriad of other approaches for shielding the connectors from the LEDs may be used as well if desired, with the only constraint being sufficient electrical separation between the LED conductors and other metallic components on the connector assembly to avoid electrical shorting.

Figure 3A:
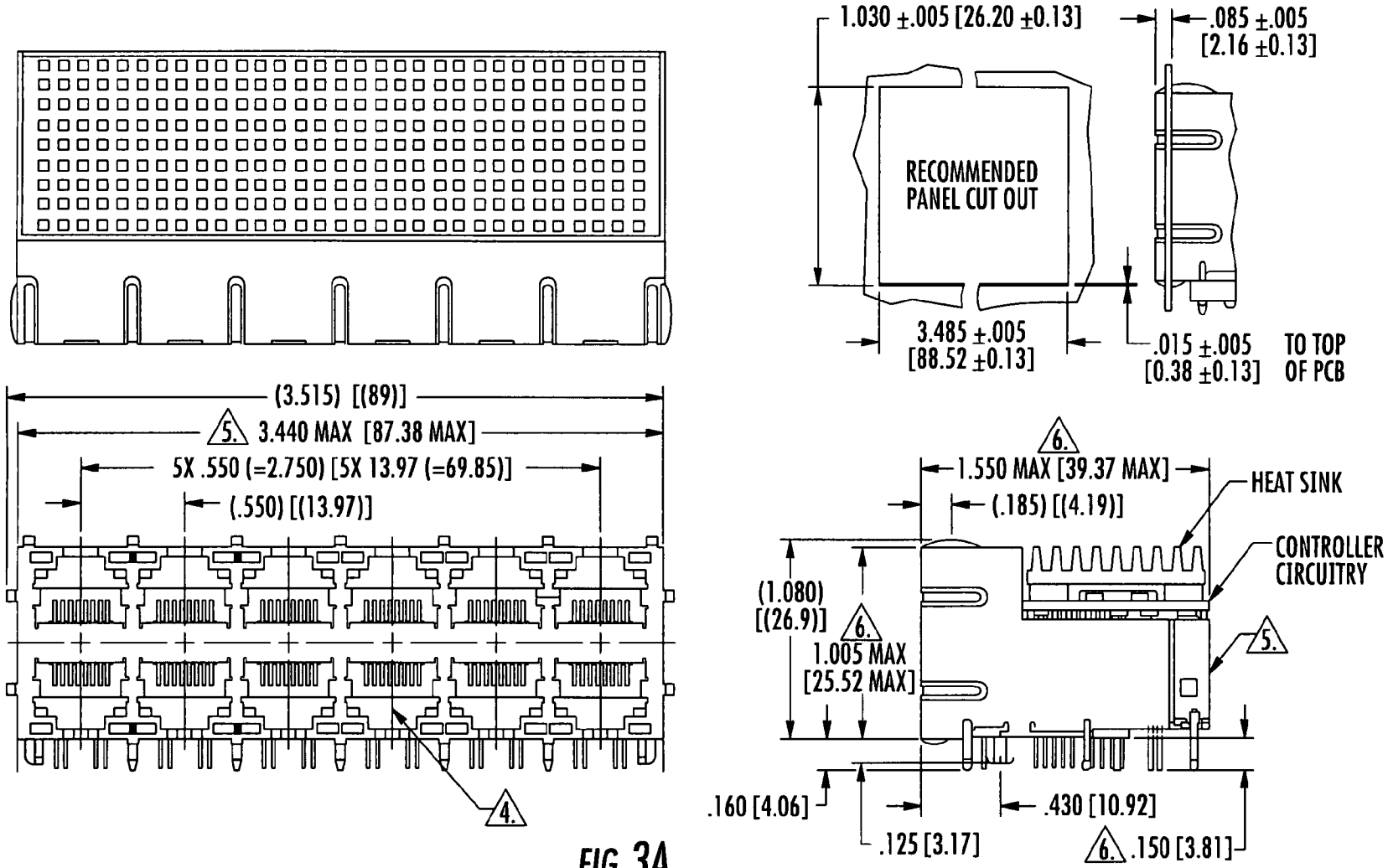
FIG. 3A is a three axis orthographic projection of the PSE enabled connector assembly of FIG. 3, in accordance with the principles of the present invention.

Referring now to FIG. 3A, a first exemplary embodiment of the connector 200 of FIG. 3 is illustrated as a three axis orthographic projection. The dimensions shown in FIG. 3A are related to one exemplary configuration, and it is recognized that other configurations and dimensions in accordance with the principles of the present invention may be readily substituted.

Figure 3B:
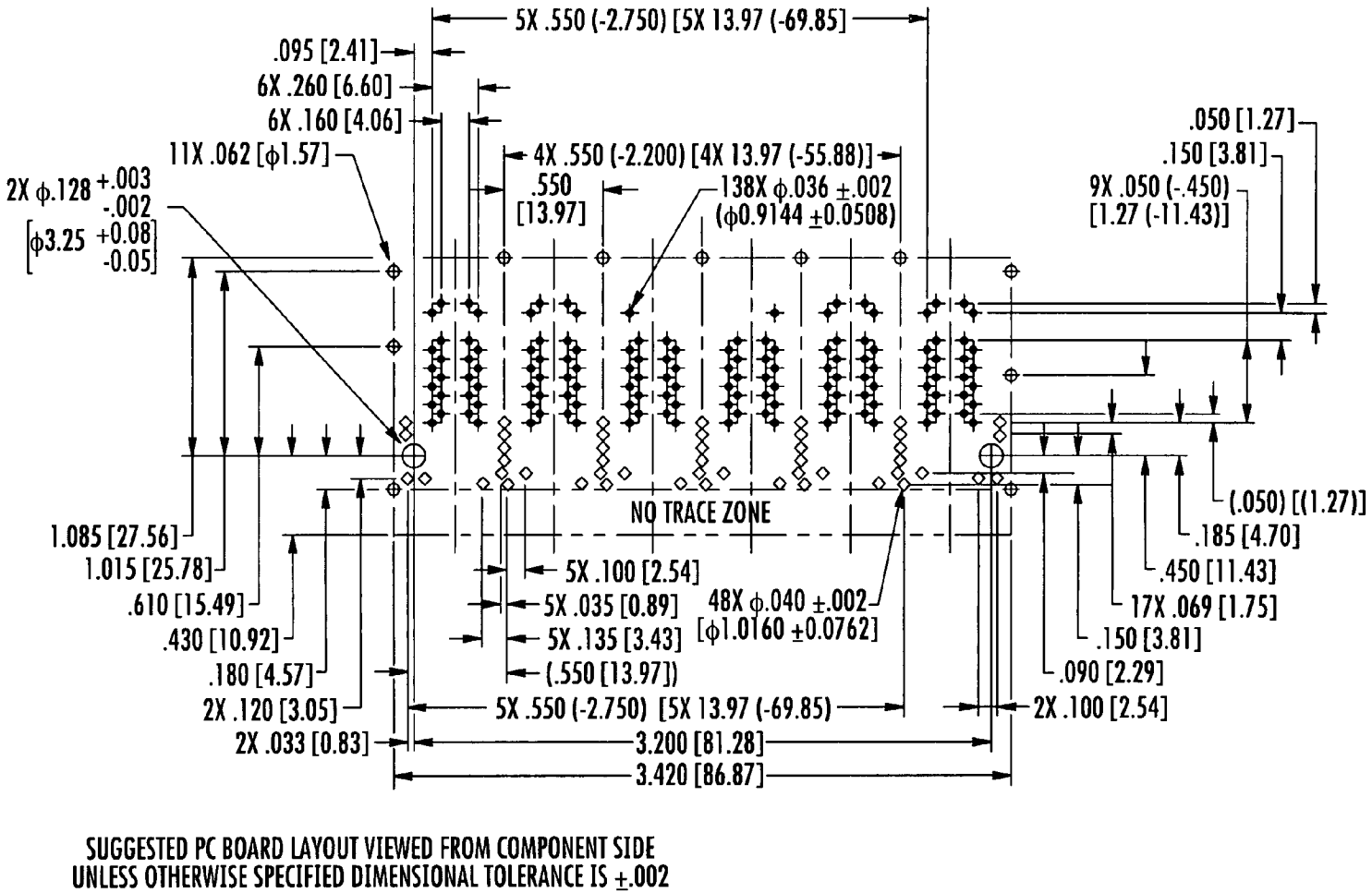
FIG. 3B is a plan view of an exemplary footprint layout for the PSE enabled connector assembly shown in FIG. 3A.

FIG. 3B illustrates an exemplary footprint or "pin-out" diagram for a printed circuit board to which the connector shown in FIG. 3A may be mounted.

Single-Port Embodiment

In another embodiment of the connector assembly of the invention, a single-port device (not shown) is provided. As indicated above, although the invention is primarily described in the context of an RJ-type modular jack (e.g., RJ-45 jack), the single-port embodiment is in no way limited to such configurations, and may be more broadly applied to others.

According to this embodiment, the assembly is housed in an electrically non-conductive housing. As discussed in above with regard to the multi-port configuration, the housing may be formed of thermoplastic, or other similar material; likewise it may even be comprised of a conductive or semi-conductive material. Further, the housing may be formed by injection molding, transfer molding, die-casting, or other methods well known in the arts.

Also as indicated above, the assembly may optionally be shielded with, inter alia, an external tin or alloy noise or Faraday shield.

The connector assembly in this embodiment is comprised of a single plug recess. As discussed in relation to the multi-port embodiment, the modular plug recess is formed in the front wall of the port such that that a modular plug may be inserted into the connector without interference. The plug recess is adapted to receive one modular plug, and is thus lined with a plurality of grooves to accommodate the modular plug. These grooves are conformed to fit to the physical shape of the modular plug the plug recess is adapted to receive. Further, as discussed above, the modular plug and the plug recess each comprise conductors which mate when the modular plug is inserted into the plug recess.

A header assembly may be utilized to dispose the connector conductors within the port recess, as discussed previously. The universal configuration discussed above may also be applied in the single-port embodiment. The electronic circuitry described above in relation to the multi-port embodiment may be utilized within the housing of in this embodiment as well.

The PSE controller board is comprised of components identical to those described above. To accommodate the controller board, the assembly is shaped as previously discussed such that a "deck" exists on the top face of the housing. The PSE controller board is mounted on the deck. Further, the PSE controller board may have a "snap-on" configuration of the type previously described in this embodiment.

In another embodiment, the heat sink described above with regard to the multi-port assembly may be optionally mounted on top of the aforementioned PSE controller board.

In another embodiment, the single-port assembly further includes light indicators. The light indictors may be placed on the top or bottom of the assembly as is necessitated by the jack configuration. The light source for the light indicators may be directly mounted within the connector assembly, or may be mounted elsewhere and transmitted via a light pipe. Further, the connector may be shielded from light sources by a plurality of approaches as discussed above.

Power Control Circuitry

The connector assembly 200 may advantageously employ power control circuitry. The power control circuitry can be adapted to provide the assembly with the ability to, inter alia, receive electrical power over a cable (e.g., a twisted pair wire and associated modular plug), process, and distribute or otherwise utilize this power for various functions.

The power control circuitry in one embodiment is designed to meet the requirements of the IEEE Std. 802.3af, and is intended for use as the front end of power sourcing equipment (PSE). In a first variant, the circuitry is adapted for use in a multi-port, RJ-type (here, RJ-45) modular connector assembly such as that of FIG. 2. As is well known, IEEE Std. 802.3af defines various standardized attributes of Ethernet power-sourcing equipment and powered terminals. The specification includes the delivery 48 VDC power over unshielded twisted-pair wiring. It is adapted to be compatible with an existing cable network, including Category 3, 5, 5e or 6, without requiring modification.

In one variant, the power control circuitry manages the DC power provided to the PD. The exemplary power control circuitry, when connected to a powered Ethernet network, will determine a power mode for the validated PD, supply power to the PD, monitor the power, and reduce or remove the power from the PD when the power is no longer requested or required. During detection, if the PSE finds the PD to be non-compatible, the PSE can prevent the application of power to that PD device, protecting the PD from possible damage. Further, the PSE may be adapted to prevent power over Ethernet cables from transmitting abnormal power to the other circuitry with which it is in communication as disclosed in e.g., U.S. Pat. No. 7,187,268 to Armstrong, et al. issued Mar. 6, 2007 and entitled "System and method for safely controlling, and receiving status of, power over Ethernet" incorporated herein by reference in its entirety.

It will also be recognized that the power control circuitry may be adapted to guarantee the supply of power to selected ports and to allow or inhibit the supply of power to ports other than the selected ports, having regard to a specified limit on the supply of power by the controllable power source and the total guaranteed power to the selected ports. For example, the system and methods for managing power described in U.S. Pat. No. 7,155,622 to Mancy, et al. issued Dec. 26, 2006 and entitled "System and method for the management of power supplied over data lines" incorporated herein by reference in its entirety, may be used consistent with the present invention if desired.

Further, it will be recognized that the power control circuitry disclosed herein may also be adapted to distinguish, in response to a detection signal, whether the device is a short circuit or a network interface card. For example, the apparatus and methods disclosed in U.S. Pat. No. 7,230,412 to Stineman, et al. issued Jun. 12, 2007 and entitled "Distinguish network interface card from short circuit condition in power over Ethernet system", incorporated herein by reference in its entirety, may be used consistent with the present invention to provide such functionality. In essence, the power control circuitry would be able to detect a short circuit if the detection signal value is in a first predetermined range, and detects a NIC if the detection signal value is in a second predetermined range outside of the first predetermined range.

System

Figure 4:
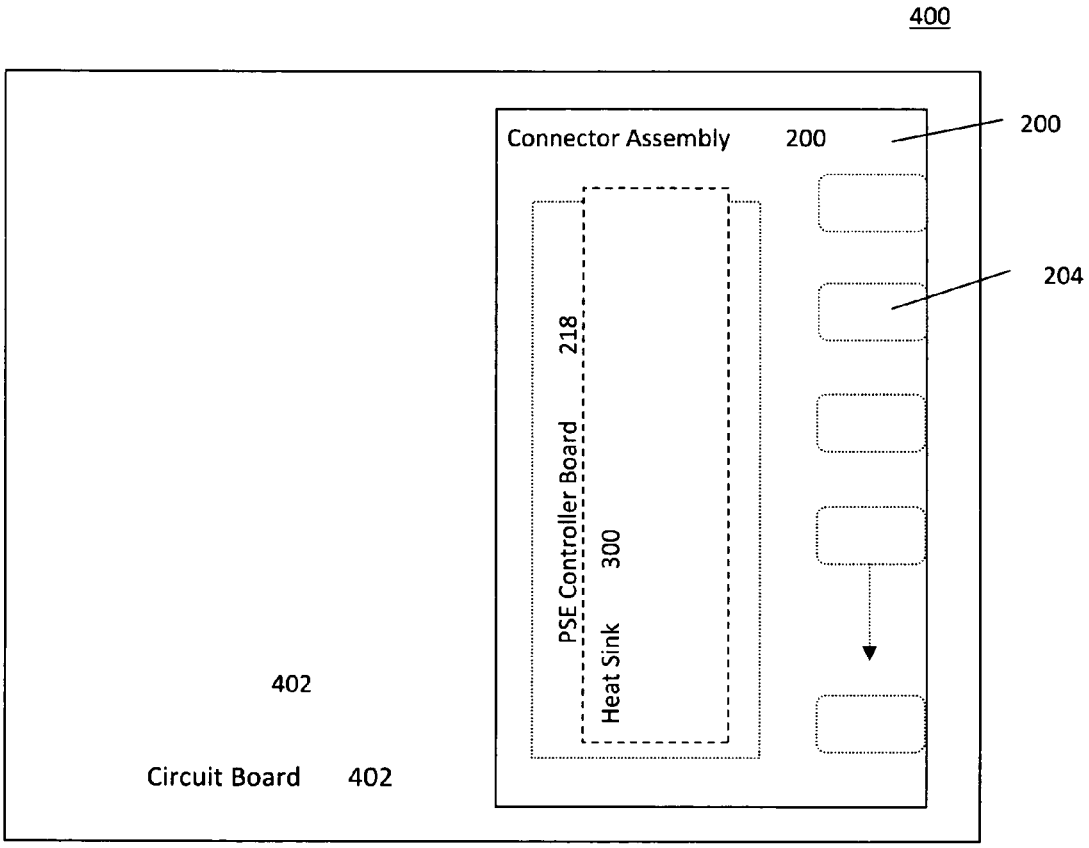
FIG. 4 is a top plan view of an exemplary embodiment of an improved PoE enabled electronic assembly system.

Referring now to FIG. 4, another aspect of the invention, a PoE-enabled electronic system 400 is disclosed. The system utilizes the aforementioned connector assembly 200. In one embodiment, the connector assembly 200 comprises a plurality of ports 204. The assembly 200 is mounted by soldering or other technique to an external circuit board 402. The circuit board 402 may be adapted to comprise a plurality of conductive traces formed on its face. A conductive pathway is thereby formed from the traces through the conductors of the respective connectors of the package.

In another embodiment (not shown), the connector assembly 200 is mounted on an intermediary substrate, the latter being mounted to a circuit board or other component using a reduced footprint terminal array. For example, the apparatus and methods described in co-owned U.S. Pat. No. 5,973,932 to Nguyen issued Oct. 26, 1999 entitled "Soldered component bonding in a printed circuit assembly", incorporated herein by reference in its entirety, may be used consistent with the present invention.

Method of Manufacture

Figure 5:
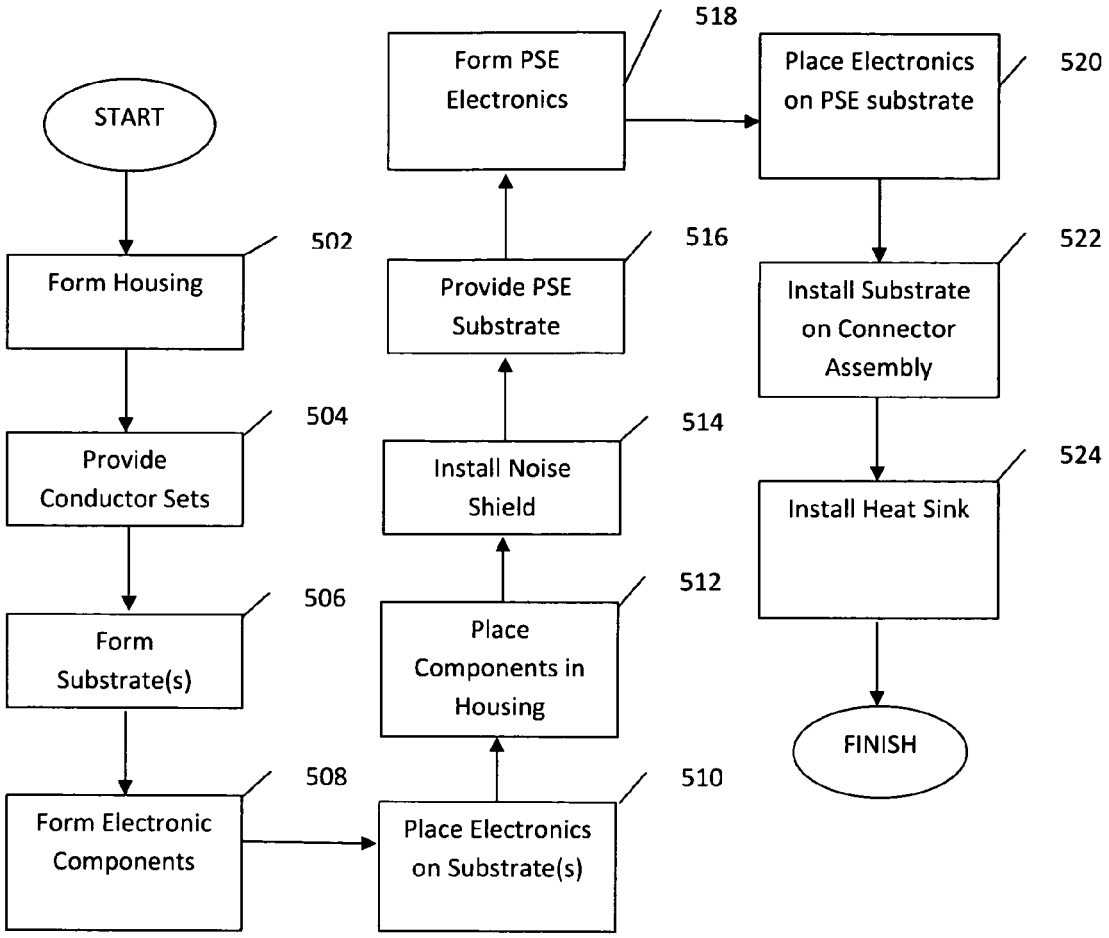
FIG. 5 is a logical flow diagram depicting one exemplary method of manufacturing the connector assembly according to the principles of the present invention.

Referring now to FIG. 5, a method of manufacturing the aforementioned connector assembly 200 is illustrated and described in detail. It is noted that while the following description of the method is cast in terms of the multi-port connector assembly of FIG. 3, the broader principles of the disclosed methodology of the invention are equally applicable and readily adapted to other configurations such as single-port configurations, heat-sink less configurations, etc.

The method generally comprises first forming the assembly housing element in step 502. The housing is preferably formed using an injection molding process of the type well known in the electronic arts, although other processes may be used. The injection molding process is selected for its ability to accurately replicate small details of the mold, low cost, accurate repeatability and ease of processing.

Next, the conductors 212 are provided in step 504. As previously described, the exemplary conductor sets comprise metallic (e.g., copper, iron-nickel or phosphor-bronze alloy) strips having a substantially square or rectangular cross-section and sized to fit within the slots of the connectors in the housing. The conductors 212 may be formed from a flat sheet of base material or, they may be formed from rectangular or circular wire stock, or any other suitable material and/or technique as is appropriate. Further, the conductors 212 may be formed in a header assembly (not shown) as discussed above.

In step 506, the substrates to which the electronic components of the connector assembly 200 will be mounted are formed. Methods for forming substrates are well known in the electronic arts, and accordingly are not described further herein.

One or more electronic components are formed and prepared in step 508. The manufacture and preparation of such electronic components is well known in the art, and accordingly not described further herein.

In step 510, the relevant electronic components are disposed on the substrate(s). Alternatively, if no components are used the conductive traces formed on/within the primary substrate will form the conductive pathway. The components may optionally be (i) received within corresponding apertures designed to receive portions of the component (e.g., for mechanical stability), (ii) bonded to the substrate such as through the use of an adhesive or encapsulant, (iii) mounted in "free space" (i.e., held in place through tension generated on the electrical leads of the component when the latter are terminated to the substrate conductive traces and/or conductor distal ends, or (iv) maintained in position by other means. The components are electrically coupled to the PCB using a eutectic soldering process (such as IR reflow) as is well known in the art.

In step 512, the substrates containing the soldered electrical components are disposed inside the connector housing.

An external noise shield (if used) may be fitted onto the assembled connector 200 as per step 514, and the various ground straps and clips are positioned so as to become fixed to the housing and optionally provide grounding of the noise shield to internal electronic components (via the substrates), etc.).

In step 516, the PSE substrate board 218 is provided. Then, in step 518, the electronic components 220 to be placed on the PSE board 218 are provided and/or formed. In step 520, these electronic components 220 are placed on the PSE board 218 in a manner similar to that discussed at step 510 above.

At step 522, the PSE controller board 218 is next disposed on top of the connector assembly 200. As discussed previously above, the PSE board 218 is placed on a face of the connector assembly 200, behind the ports 204.

At step 524, a heat sink 300 may optionally be disposed atop the PSE controller board 218. Note that step 524 may be obviated in embodiments (such as those described in FIG. 2) where a heat sink 300 is not necessary. In addition, it is also recognized that the heat sink 300 may be combined with the PSE controller board 218 prior to being disposed on top of the connector assembly 200 so that both the PSE controller board and heat sink are installed simultaneously.

Finally, in one embodiment, the connector assembly 200 is disposed on a parent substrate. The connector assembly 200 terminals (not shown) are bonded to the substrate contacts such as via soldering or welding to ensure a rigid electrical connection for each. The completed insert assembly may be optionally electrically tested in process to ensure proper operation if desired either before or after this final processing step.

With respect to the other embodiments described herein (i.e., single connector housing, connector assembly with LEDs or light pipes, etc.), the foregoing method may be modified as necessary to accommodate the additional components. Conversely, in certain embodiments, steps may be omitted by virtue of those features not being incorporated into the design. For instance, in one embodiment, it may be desirable to only have PSE electronic components, and thus steps 508 and 510 may be obviated. Such modifications and alterations will be readily apparent to those of ordinary skill, given the disclosure provided herein.

Business Method

A method of doing business with regard to the aforementioned PoE enabled connector assembly 200 is also disclosed. The method generally comprises providing a pre-manufactured connector assembly (which does not contain or include a PSE controller board). The pre-manufactured connector assembly may be manufactured by a third party manufacturer not involved in the manufacture of the PSE controller board itself. The provided connector assembly may be of the "deck" configuration outlined above; however, one may practice the invention on any configuration of connector assembly, and the invention is in no way limited to such configuration. Further, although the description and illustrations are cast in terms of a 2×N multi-port assembly, other configurations (e.g., single port, 1×N, etc.) may be utilized consistent with the principles of the present invention.

Next, a PSE controller board is provided. The PSE controller board is then mounted on a face of connector assembly (outside the connector housing), thereby creating a PoE-enabled connector assembly. The method may further comprise disposing a heat sink atop the controller board as it rests on the top face of the connector assembly. In this manner, manufacturers of the finished product may optionally choose to manufacture the PSE controller board and optional heat sink themselves, thereby reducing product costs resulting from the fact that they are not charged with the third party manufacturer's overhead costs (i.e., the cost of the mounted PSE controller board).

Other business methods which separate and/or modularize different aspects of the PSE connector assembly consistent with the principles of the aforementioned business methodology are envisioned as well.

For instance, in one embodiment, the Contract Equipment Manufacturer ("CEM") can, immediately prior to shipment to the customer, configure the appropriate PSE connector assembly. This provides increased flexibility as the connector design possesses the ability to customize the product up to and immediately before shipment.

In addition, because the PSE connector assembly is integrated with a PSE controller substrate, manufacturing yields are improved on customer printed circuit boards thereby avoiding costly rework by the end customer that mounts the assembly onto their motherboard.

Further, an integrated PSE connector assembly allows a CEM to easily "second-source" components of the PSE connector assembly from an alternate third party vendor, thereby ensuring an immediate supply of connector assemblies should a first vendor experience production issues. For example, the integrated design allows a CEM to purchase the PSE controller substrate from multiple vendors, thereby ensuring a steady supply should quality control issues arise at a given vendor.

The integrated PSE connector assembly also provides advantages in that the product can be reworked and/or reconfigured in the field, thereby providing improved flexibility for the end customer.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An apparatus for providing power over data cabling, comprising:

a connector assembly comprised of a plurality of ports, said ports each comprising a plurality of conductors that collectively supply both a power signal and a data signal over data cabling;

a controllable power source, said power source being operatively coupled to said ports and supplying power thereto;

a processor disposed on a substrate, said processor controlling the supply of power by said power source; and an external shielding apparatus;

wherein said substrate is disposed substantially on a face of said connector assembly and external to said external shielding apparatus.

2. The apparatus of claim 1, further comprising a heat sink, said heat sink being disposed substantially on said processor.

3. The apparatus of claim 2, wherein said face comprises an external face of said connector assembly.

4. The apparatus of claim 3, wherein the external face comprises a top face, and wherein said heat sink is disposed below the highest surface of said connector assembly.

5. The apparatus of claim 1, wherein said substrate is disposed removably onto said connector assembly so that removal thereof can occur without necessitating a de-soldering operation.

6. The apparatus of claim 1, wherein said substrate is configured so as to permit disposal thereof onto said connector assembly after said connector assembly has otherwise been fully assembled.

7. The apparatus of claim 1, wherein said substrate further comprises a shielding layer.

8. The apparatus of claim 7, wherein said shielding layer is electrically coupled to said external shielding apparatus.

9. An apparatus for providing power over data cabling, comprising:

a connector assembly comprised of a plurality of ports, said ports being capable of supplying a power signal and a data signal, said connector assembly further comprising:

an external substrate mounting interface disposed on a deck surface associated with said connector assembly, said deck surface being parallel with a top surface of said connector assembly, said deck surface disposed substantially below said top surface of said connector assembly; and an external shield; and a substrate comprising one or more heat-generating electronic components for providing power over data cabling associated with one or more of said plurality of ports, said one or more heat-generating electronic components disposed on said substrate operable to:

detect a compatible powered device (PD);

determine a power classification signature for the compatible PD; and supply power to the compatible PD; and wherein said substrate is mounted to said connector assembly via said external substrate mounting interface; and wherein an upper most component of said one-or-more heat generating electronic components is disposed entirely below said top surface of said connector assembly when said substrate is mounted on said external substrate mounting interface and said deck surface.

10. The apparatus of claim 9, wherein said external substrate mounting interface comprises a solder-less mounting interface.

11. A method for assembling an apparatus for providing power over data cabling, comprising:

assembling a connector assembly comprised of a plurality of ports, said ports being capable of supplying a power signal and a data signal over data cabling;

obtaining a controllable power source operatively coupled to said ports and supplying power thereto and a processor disposed on a substrate, said processor operative to control the supply of power by said power source;

assembling an external shielding apparatus about said connector assembly; and disposing said substrate comprising said controllable power source and said processor onto a face of said assembled connector assembly external to said external shielding apparatus.

12. The method of claim 11, wherein said substrate is disposed removably onto said connector assembly such that it can be removed without necessitating a de-soldering operation.

13. The method of claim 11, wherein said act of disposing said substrate is performed using a solder free assembling operation.

14. The method of claim 11, wherein said substrate is disposed onto an upper surface deck associated with said connector assembly.

15. An apparatus for providing power over data cabling, comprising:

connector means comprised of a plurality of ports, said ports each comprising a plurality of conductor means for supplying both power and a data signal over data cabling;

a controllable power source, said power source being operatively coupled to said ports and supplying power thereto;

processing means disposed on a substrate, said processing means at least partly controlling the supply of power by said power source; and an external shielding apparatus;

wherein said substrate is disposed substantially on a face of said connector assembly and external to said external shielding apparatus.

* * * * *

UNITED STATES PATENT AND TRADEMARK OFFICE

CERTIFICATE OF CORRECTION

PATENT NO. : 7,845,984 B2
APPLICATION NO. : 12/495653
DATED : December 7, 2010
INVENTOR(S) : Christopher P. Schaffer and Thomas Rascon It is certified that error appears in the above-identified patent and that said Letters Patent is hereby corrected as shown below:

Title Page

CURRENTLY READS

Item (56) References Cited 6,585,540 B2 7/2003 Doyle, III et al.

SHOULD READ

Item --(56) References Cited 6,585,540 B2 7/2003 Gutierrez, et al.--

Signed and Sealed this
Eighth Day of February, 2011

David J. Kappos

David J. Kappos
*Director of the United States Patent and Trademark Office*